US009437094B2

(12) United States Patent
Goldenson

(10) Patent No.: US 9,437,094 B2
(45) Date of Patent: Sep. 6, 2016

(54) NON-RADIOACTIVE IONIZING SMOKE DETECTORS AND METHODS FOR USE THEREOF

(71) Applicant: Google Inc., Mountain View, CA (US)

(72) Inventor: Andrew W. Goldenson, Palo Alto, CA (US)

(73) Assignee: GOOGLE INC., Mountain View, CA (US)

( * ) Notice: Subject to any disclaimer, the term of this patent is extended or adjusted under 35 U.S.C. 154(b) by 0 days.

(21) Appl. No.: 14/645,916

(22) Filed: Mar. 12, 2015

(65) Prior Publication Data

US 2015/0262464 A1 Sep. 17, 2015

Related U.S. Application Data

(60) Provisional application No. 61/952,117, filed on Mar. 12, 2014.

(51) Int. Cl.
*G08B 17/10* (2006.01)
*G08B 17/11* (2006.01)

(52) U.S. Cl.
CPC ..... *G08B 17/11* (2013.01)

(58) Field of Classification Search
CPC .... G08B 17/11; G08B 17/10; G08B 29/043; B01J 35/004; B01J 21/063
USPC ..... 340/628, 629, 630; 73/335.04, 31.06
See application file for complete search history.

(56) References Cited

U.S. PATENT DOCUMENTS 4,121,548 A * 10/1978 Hattori ..... F02D 41/1441 123/479
4,177,787 A * 12/1979 Hattori ..... F02D 41/1441 123/198 D
4,339,320 A * 7/1982 Friese ..... G01N 27/4077 204/408
4,615,772 A * 10/1986 Hetrick ..... G01N 27/305 204/400
6,238,536 B1 * 5/2001 Lundgren ..... G01N 27/417 204/425
8,911,670 B2 * 12/2014 Wang ..... B01D 53/8668 422/120
9,265,001 B1 * 2/2016 Tannenbaum .... H04W 52/0235
2002/0094298 A1 * 7/2002 Monagan ..... A61L 9/20 422/5
2005/0269254 A1 * 12/2005 Roitman ..... B01D 5/0072 210/252
2010/0307238 A1 * 12/2010 Van Popta ..... G01N 27/225 73/335.04
2014/0223997 A1 * 8/2014 Gole ..... B82Y 15/00 73/31.06
2014/0311221 A1 * 10/2014 Gole ..... G01N 27/127 73/31.06
2015/0262464 A1 * 9/2015 Goldenson ..... G08B 17/11 340/629
2016/0042638 A1 * 2/2016 Sangha ..... G08B 17/10 340/628

* cited by examiner

*Primary Examiner* — Hoi Lau
(74) *Attorney, Agent, or Firm* — Van Court & Aldridge LLP

(57) ABSTRACT

A smoke detector according to various embodiments discussed herein can use a non-radioactive ionization technique to detect the presence of smoke and/or other particulate matter. A non-radioactive ionizing detector may use a LED such as an ultraviolet light emitting diod in combination with a pair of conductive plates, one of which is coated with a photocatalyst coating. When the light strikes the photocatalyst coating, ions can be generated that change a charge characteristic of the photocatalytic coated plate. The occurrence of an alarm can be detected based on a measured charge magnitude existing between the two plates.

19 Claims, 6 Drawing Sheets

NON-RADIOACTIVE IONIZING SMOKE DETECTORS AND METHODS FOR USE THEREOF

CROSS-REFERENCE TO RELATED APPLICATION

This patent application claims priority to U.S. Provisional Patent Application No. 61/952,117, filed Mar. 12, 2014. The above-referenced patent application is incorporated by reference in its entirety for all purposes.

TECHNICAL FIELD

This patent specification relates to a hazard detection system. More particularly, this patent specification relates to non-radioactive ionization detectors and methods for the use thereof.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Hazard detection systems such as smoke detectors, carbon monoxide detectors, combination smoke and carbon monoxide detectors, as well as systems for detecting other dangerous conditions have been used in residential, commercial, and industrial settings for safety considerations.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

A smoke detector according to various embodiments discussed herein uses a non-radioactive ionization technique to detect the presence of smoke and/or other particulate matter. A non-radioactive ionizing detector may use a LED such as an ultraviolet emitting LED in combination with a photocatalyst. The photocatalyst may be deposited on one of two parallel plates and can generate ions when light (e.g., UV light) strikes it. The presence of the ions can cause a measurable charge differential between the plates. When smoke enters the chambers, the light may not sufficiently strike the photocatalyst to thereby produce the ions needed to provide the measurable charge difference. As a result, the lack of charge difference may signal the occurrence of a smoke or fire event. In effect, the smoke detector behaves similar to an obscuration meter; when smoke obscures the light, fewer ions are created and a lower charge is measured.

In one embodiment, a non-radioactive smoke detection system is provided. The system can include a chamber having an interior volume and at least one opening to an ambient environment, a pair of conductive plates contained in the interior volume, wherein one of the plates is coated with a photocatalytic coating, a light source contained in the interior volume and aimed to emit electromagnetic energy towards the photocatalytic coated plate, and circuitry coupled to the conductive plates and the light source. The circuitry can be operative to activate the light source to emit electromagnetic energy that strikes the photocatalytic coated plate, the electromagnetic energy causing ions to be generated when it strikes the photocatalytic coated plate, wherein the ions alter a charge characteristic of the photocatalytic coated plate. The charge magnitude between the conductive plates can be monitored to determine whether an alarm event is detected.

In another embodiment, a non-radioactive smoke detection system is provided. This system can include a chamber having an interior volume and at least one opening to an ambient environment, a photocatalytic coated conductive plate and a reference conductive plate contained in the interior volume, a photodiode contained in the interior volume, and a light source contained in the interior volume. The light source can include an ultraviolet (UV) light emitting diode (LED), and an infrared (IR) LED. Circuitry can be coupled to the conductive plates, the light source, and the photodiode. The circuitry can be operative to use an ion-based detection scheme to monitor particulates based on an obscuration approach within the chamber, and at the same time use a particle scattering detection scheme by mounting a photodiode outside of the direct line of site of the UV (or IR) LED. By looking at the signals of these two approaches, this combined method can additional insight into the type of particles in the chamber.

In yet another embodiment, a method for detecting particles in a non-radioactive hazard detector system is provided. The method can include activating a light source to emit electromagnetic energy that is aimed to strike a photocatalytic plate. The electromagnetic energy can cause ions to be generated when it strikes the photocatalytic plate, and the ions can alter a charge characteristic of the photocatalytic plate. A charge magnitude across the photocatalytic plate and the reference plate can be measured while the light source is activated. A determination can be made as to whether the charge magnitude exceeds an alarm threshold, and an alarm can be activated if the charge magnitude is below the alarm threshold.

Various refinements of the features noted above may be used in relation to various aspects of the present disclosure. Further features may also be incorporated in these various aspects as well. These refinements and additional features may be used individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

A further understanding of the nature and advantages of the embodiments discussed herein may be realized by reference to the remaining portions of the specification and the drawings.

DETAILED DESCRIPTION OF THE DISCLOSURE

Figure 1:
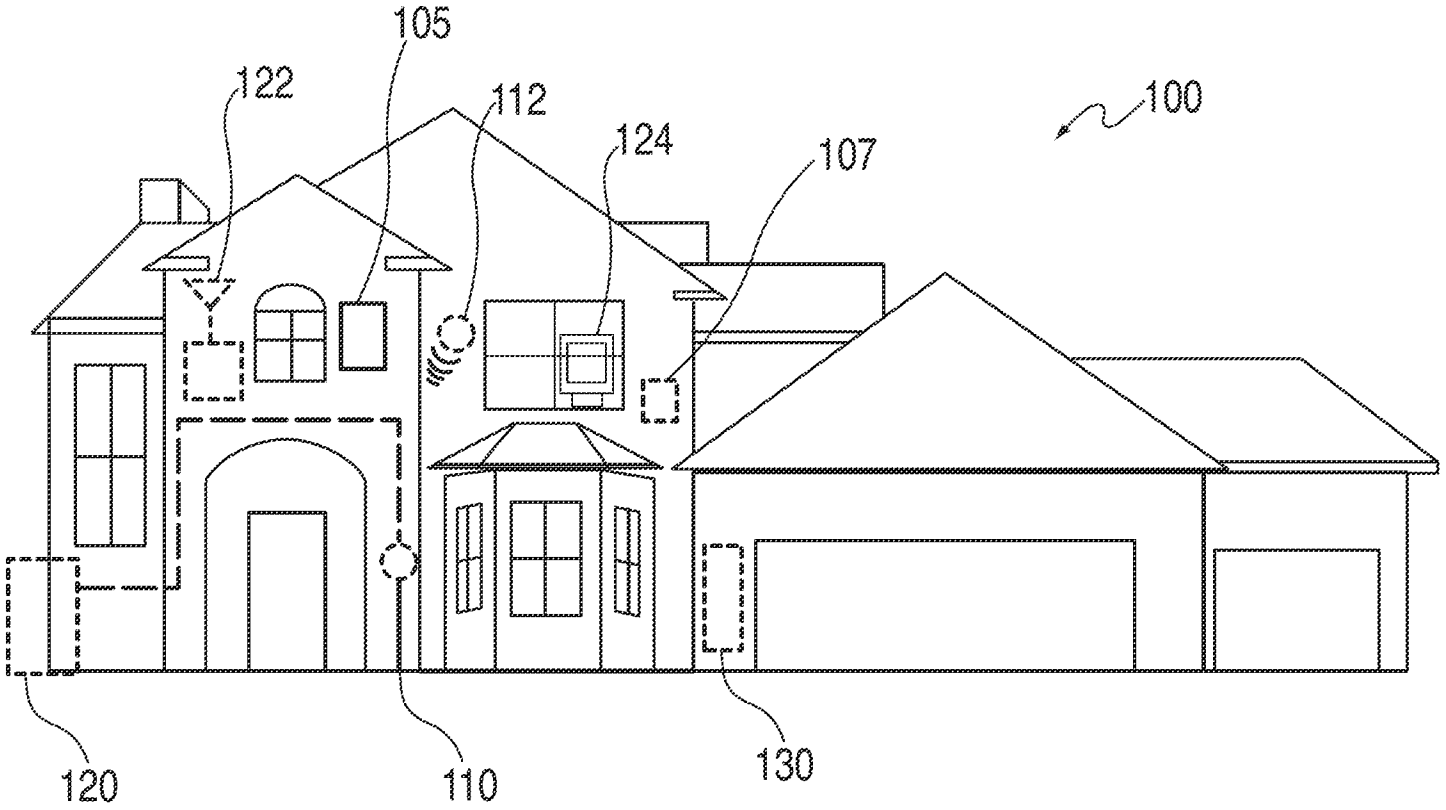
FIG. 1 is a diagram of an enclosure with a hazard detection system, according to some embodiments.

In the following detailed description, for purposes of explanation, numerous specific details are set forth to provide a thorough understanding of the various embodiments. Those of ordinary skill in the art will realize that these various embodiments are illustrative only and are not intended to be limiting in any way. Other embodiments will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual embodiment, numerous embodiment-specific decisions may be required to achieve specific design objectives. These design objectives will vary from one embodiment to another and from one developer to another. Moreover, it will be appreciated that such a development effort might be complex and time-consuming but would nevertheless be a routine engineering undertaking for those of ordinary skill in the art having the benefit of this disclosure.

It is to be appreciated that while one or more hazard detection embodiments are described further herein in the context of being used in a residential home, such as a single-family residential home, the scope of the present teachings is not so limited. More generally, hazard detection systems are applicable to a wide variety of enclosures such as, for example, duplexes, townhomes, multi-unit apartment buildings, hotels, retail stores, office buildings, and industrial buildings. Further, it is understood that while the terms user, customer, installer, homeowner, occupant, guest, tenant, landlord, repair person, and the like may be used to refer to the person or persons who are interacting with the hazard detector in the context of one or more scenarios described herein, these references are by no means to be considered as limiting the scope of the present teachings with respect to the person or persons who are performing such actions.

Smoke detectors generally work according to an ionization technique or a light scattering technique. Conventional ionization techniques use a radioactive source to ionize air within the smoke chamber. The radioactive source is typically Americium-241 and can convert air molecules into positive and negative ions. In a conventional radioactive ionization smoke detector, a small amount of radioactive material may be placed between two electrically charged plates. The radiation emitting from the radioactive material ionizes the air between the plates and causes a current to flow between the plates. When smoke enters the smoke chamber, it disrupts ionization of the air, thereby reducing the current flow. Particularly, the ions may bond with the smoke or be displaced by the smoke, thus breaking the current flow between the two plates. When this reduced current flow is detected, an alarm may be activated. In conventional ionization smoke detectors, the radioactive source serves as the ionization source. Use of radioactive materials, however, is not desired, and some jurisdictions outlaw their use in commercial products such as smoke detectors.

The light scattering technique may be used in a photoelectric smoke alarm. In a photoelectric smoke alarm, a light source is aimed into a sensing chamber at an angle away from a sensor. Smoke enters the chamber, scatting light onto the light sensor, thereby triggering the alarm.

A smoke detector according to various embodiments discussed herein uses a non-radioactive ionization technique to detect the presence of smoke and/or other particulate matter. A non-radioactive ionizing detector may use a LED such as an ultraviolet emitting LED in combination with a photocatalyst. The photocatalyst may be deposited on one of two parallel plates and can generate ions when light (e.g., UV light) strikes it. The presence of the ions can cause a measurable charge differential between the plates. When smoke enters the chambers, the light may not sufficiently strike the photocatalyst to thereby produce the ions needed to provide the measurable charge difference. As a result, the lack of charge difference may signal the occurrence of a smoke or fire event. Non-radioactive ionization detectors have several advantages over their conventional radioactive counterparts. These advantages include elimination of a radioactive substance to provide an ionization source, and enhanced power savings since there is no need to charge the plates. In addition, the non-radioactive ionization may purify the air as a byproduct of monitoring for the presence of smoke. Moreover, the same light source that strikes the photocatalyst may be used in conjunction with a photodiode detect presence of smoking using the light scattering technique. Additional details of various non-radioactive ionizing smoke detectors are discussed in more detail below in connection with FIGS. 3-8.

FIG. 1 is a diagram illustrating an exemplary enclosure 100 using hazard detection system 105, remote hazard detection system 107, thermostat 110, remote thermostat 112, heating, cooling, and ventilation (HVAC) system 120, router 122, computer 124, and central panel 130 in accordance with some embodiments. Enclosure 100 can be, for example, a single-family dwelling, a duplex, an apartment within an apartment building, a warehouse, or a commercial structure such as an office or retail store. Hazard detection system 105 can be battery powered, line powered, or be line powered with a battery backup. Hazard detection system 105 can include one or more processors, multiple sensors, non-volatile storage, and other circuitry to provide desired safety monitoring and user interface features. Some user interface features may only be available in line powered embodiments due to physical limitations and power constraints. In addition, some features common to both line and battery powered embodiments may be implemented differently. Hazard detection system 105 can include the following power consuming components: low power wireless personal area network (LoWPAN) circuitry, a system processor, a safety processor, non-volatile memory (e.g., Flash), WiFi circuitry, an ambient light sensor (ALS), a smoke sensor, a carbon monoxide (CO) sensor, one or more temperature sensors, one or more ultrasonic sensors, a passive infra-red (PIR) sensor, a speaker, one or more LED's, and a buzzer. It is understood multiple instances of the same component may exist, whereas other components may only exist in one instance.

Hazard detection system 105 can monitor environmental conditions associated with enclosure 100 and alarm occupants when an environmental condition exceeds a predetermined threshold. The monitored conditions can include, for example, smoke, heat, humidity, carbon monoxide, carbon dioxide, radon, and other gasses. In addition to monitoring the safety of the environment, hazard detection system 105 can provide several user interface features not found in conventional alarm systems. These user interface features can include, for example, vocal alarms, voice setup instructions, cloud communications (e.g. push monitored data to the cloud, or push notifications to a mobile phone, receive commands from the cloud such as a hush command), device-to-device communications (e.g., communicate with other hazard detection systems in the enclosure), visual safety indicators (e.g., display of a green light indicates it is safe and display of a red light indicates danger), tactile and non-tactile input command processing, and software updates.

Hazard detection system 105 can implement multi-criteria state machines according to various embodiments described herein to provide advanced hazard detection and advanced user interface features such as pre-alarms. In addition, the multi-criteria state machines can manage alarming states and pre-alarming states and can include one or more sensor state machines that can control the alarming states and one or more system state machines that control the pre-alarming states. Each state machine can transition among any one of its states based on sensor data values, hush events, and transition conditions. The transition conditions can define how a state machine transitions from one state to another, and ultimately, how hazard detection system 105 operates. Hazard detection system 105 can use a dual processor arrangement to execute the multi-criteria state machines according to various embodiments. The dual processor arrangement enables hazard detection system 105 to manage the alarming and pre-alarming states in a manner that uses minimal power while simultaneously providing relatively failsafe hazard detection and alarming functionality.

Enclosure 100 can include any number of hazard detection systems. For example, as shown, hazard detection system 107 is another hazard detection system, which may be similar to system 105. In one embodiment, both systems 105 and 107 can be battery powered systems. In another embodiment, system 105 may be line powered, and system 107 may be battery powered. Moreover, a hazard detection system can be installed outside of enclosure 100.

Thermostat 110 can be one of several thermostats that controls HVAC system 120. Thermostat 110 can be referred to as the "primary" thermostat because it is electrically connected to actuate all or part of an HVAC system, by virtue of an electrical connection to HVAC control wires (e.g. W, G, Y, etc.) leading to HVAC system 120. Thermostat 110 can include one or more sensors to gather data from the environment associated with enclosure 100. For example, a sensor may be used to detect occupancy, temperature, light and other environmental conditions within enclosure 100. Remote thermostat 112 can be referred to as an "auxiliary" thermostat because it may not be electrically connected to actuate HVAC system 120, but it too may include one or more sensors to gather data from the environment associated with enclosure 100 and can transmit data to thermostat 110 via a wired or wireless link. For example, thermostat 112 can wirelessly communicate with and cooperates with thermostat 110 for improved control of HVAC system 120. Thermostat 112 can provide additional temperature data indicative of its location within enclosure 100, provide additional occupancy information, or provide another user interface for the user (e.g., to adjust a temperature setpoint).

Hazard detection systems 105 and 107 can communicate with thermostat 110 or thermostat 112 via a wired or wireless link. For example, hazard detection system 105 can wirelessly transmit its monitored data (e.g., temperature and occupancy detection data) to thermostat 110 so that it is provided with additional data to make better informed decisions in controlling HVAC system 120. Moreover, in some embodiments, data may be transmitted from one or more of thermostats 110 and 112 to one or more of hazard detections systems 105 and 107 via a wired or wireless link.

Central panel 130 can be part of a security system or other master control system of enclosure 100. For example, central panel 130 may be a security system that may monitor windows and doors for break-ins, and monitor data provided by motion sensors. In some embodiments, central panel 130 can also communicate with one or more of thermostats 110 and 112 and hazard detection systems 105 and 107. Central panel 130 may perform these communications via wired link, wireless link, or a combination thereof For example, if smoke is detected by hazard detection system 105, central panel 130 can be alerted to the presence of smoke and make the appropriate notification, such as displaying an indicator that a particular zone within enclosure 100 is experiencing a hazard condition.

Enclosure 100 may further include a private network accessible both wirelessly and through wired connections and may also be referred to as a Local Area Network or LAN. Network devices on the private network can include hazard detection systems 105 and 107, thermostats 110 and 112, computer 124, and central panel 130. In one embodiment, the private network is implemented using router 122, which can provide routing, wireless access point functionality, firewall and multiple wired connection ports for connecting to various wired network devices, such as computer 124. Wireless communications between router 122 and networked devices can be performed using an 802.11 protocol. Router 122 can further provide network devices access to a public network, such as the Internet or the Cloud, through a cable-modem, DSL modem and an Internet service provider or provider of other public network service. Public networks like the Internet are sometimes referred to as a Wide-Area Network or WAN.

Access to the Internet, for example, may enable networked devices such as system 105 or thermostat 110 to communicate with a device or server remote to enclosure 100. The remote server or remote device can host an account management program that manages various networked devices contained within enclosure 100. For example, in the context of hazard detection systems according to embodiments discussed herein, system 105 can periodically upload data to the remote server via router 122. In addition, if a hazard event is detected, the remote server or remote device can be notified of the event after system 105 communicates the notice via router 122. Similarly, system 105 can receive data (e.g., commands or software updates) from the account management program via router 122.

Figure 2:
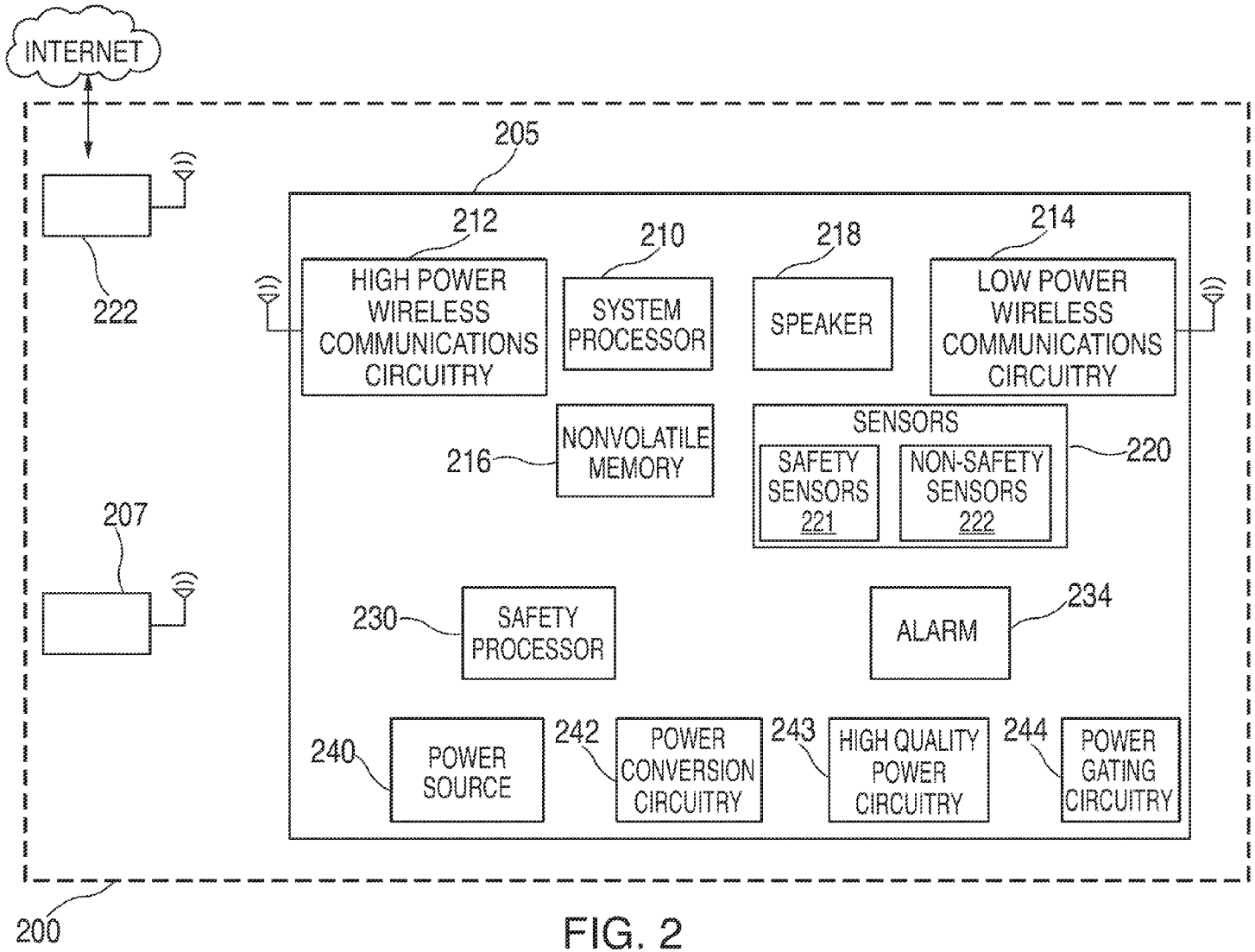
FIG. 2 shows an illustrative block diagram of a hazard detection system being used in an illustrative enclosure, according to some embodiments.

FIG. 2 shows an illustrative block diagram of hazard detection system 205 being used in an illustrative enclosure 200 in accordance with some embodiments. FIG. 2 also shows optional hazard detection system 207 and router 222. Hazard detection systems 205 and 207 can be similar to hazard detection systems 105 and 107 in FIG. 1, enclosure 200 can be similar to enclosure 100 in FIG. 1, and router 222 can be similar to router 122 in FIG. 1. Hazard detection system 205 can include several components, including system processor 210, high-power wireless communications circuitry 212 and antenna, low-power wireless communications circuitry 214 and antenna, non-volatile memory 216, speaker 218, sensors 220, which can include one or more safety sensors 221 and one or more non-safety sensors 222, safety processor 230, alarm 234, power source 240, power conversion circuitry 242, high quality power circuitry 243, and power gating circuitry 244. Hazard detection system 205 is operative to provide failsafe safety detection features and user interface features using circuit topology and power budgeting methods that minimize power consumption.

Hazard detection system 205 can use a bifurcated processor circuit topology for handling the features of system 205. Both system processor 210 and safety processor 230 can exist on the same circuit board within system 205, but perform different tasks. System processor 210 is a larger more capable processor that can consume more power than safety processor 230. That is, when both processors 210 and 230 are active, processor 210 consumes more power than processor 230. Similarly, when both processors are inactive, processor 210 still consumes more power than processor 230. System processor 210 can be operative to process user interface features and monitor interface sensors 220. For example, processor 210 can direct wireless data traffic on both high and low power wireless communications circuitry 212 and 214, access non-volatile memory 216, communicate with processor 230, and cause audio to be emitted from speaker 218. As another example, processor 210 can monitor interface sensors 220 to determine whether any actions need to be taken (e.g., shut off a blaring alarm in response to a user detected action to hush the alarm).

Safety processor 230 can be operative to handle safety related tasks of system 205. Safety processor 230 can poll one or more of sensors 220 and activate alarm 234 when one or more of sensors 220 indicate a hazard event is detected. Processor 230 can operate independently of processor 210 and can activate alarm 234 regardless of what state processor 210 is in. For example, if processor 210 is performing an active function (e.g., performing a WiFi update) or is shut down due to power constraints, processor 230 can activate alarm 234 when a hazard event is detected. In some embodiments, the software running on processor 230 may be permanently fixed and may never be updated via a software or firmware update after system 205 leaves the factory.

Compared to processor 210, processor 230 is a less power consuming processor. Thus by using processor 230 in lieu of processor 210 to monitor a subset of sensors 220 yields a power savings. If processor 210 were to constantly monitor sensors 220, the power savings may not be realized. In addition to the power savings realized by using processor 230 for monitoring the subset of sensors 220, bifurcating the processors also ensures that the safety monitoring and core alarming features of system 205 will operate regardless of whether processor 210 is functioning. By way of example and not by way of limitation, system processor 210 may comprise a relatively high-powered processor such as Freescale Semiconductor K60 Microcontroller, while safety processor 230 may comprise a relatively low-powered processor such as a Freescale Semiconductor KL15 Microcontroller. Overall operation of hazard detection system 205 entails a judiciously architected functional overlay of system processor 210 and safety processor 230, with system processor 210 performing selected higher-level, advanced functions that may not have been conventionally associated with hazard detection units (for example: more advanced user interface and communications functions; various computationally-intensive algorithms to sense patterns in user behavior or patterns in ambient conditions; algorithms for governing, for example, the brightness of an LED night light as a function of ambient brightness levels; algorithms for governing, for example, the sound level of an onboard speaker for home intercom functionality; algorithms for governing, for example, the issuance of voice commands to users; algorithms for uploading logged data to a central server; algorithms for establishing network membership; and so forth), and with safety processor 230 performing the more basic functions that may have been more conventionally associated with hazard detection units (e.g., smoke and CO monitoring, actuation of shrieking/buzzer alarms upon alarm detection). According to one or more embodiments, the judiciously architected functional overlay of system processor 210 and safety processor 230 is designed such that hazard detection system 205 can perform basic monitoring and shriek/buzzer alarming for hazard conditions even in the event that system processor 210 is inactivated or incapacitated, by virtue of the ongoing operation of safety processor 230. Therefore, while system processor 210 is configured and programmed to provide many different capabilities for making hazard detection unit 205 an appealing, desirable, updatable, easy-to-use, intelligent, network-connected sensing and communications node for enhancing the smart-home environment, its functionalities are advantageously provided in the sense of an overlay or adjunct to the core safety operations governed by safety processor 230, such that even in the event there are operational issues or problems with system processor 210 and its advanced functionalities, the underlying safety-related purpose and functionality of hazard detector 205 by virtue of the operation of safety processor 230 will continue on, with or without system processor 210 and its advanced functionalities.

High power wireless communications circuitry 212 can be, for example, a Wi-Fi module capable of communicating according to any of the 802.11 protocols. For example, circuitry 212 may be implemented using Broadcom part number BCM43362, available in a module from Murata. Depending on an operating mode of system 205, circuitry 212 can operate in a low power "sleep" state or a high power "active" state. For example, when system 205 is in an Idle mode, circuitry 212 can be in the "sleep" state. When system 205 is in a non-Idle mode such as Wi-Fi update mode, software update mode, or alarm mode, circuitry 212 can be in an active state. For example, when system 205 is in an active alarm mode, high power circuitry 212 may communicate with router 222 so that a message can be sent to a remote server or device.

Low power wireless communications circuitry 214 can be a low power Wireless Personal Area Network (6LoWPAN) module or a ZigBee module capable of communicating according to a 802.15.4 protocol. For example, in one embodiment, circuitry 214 can be part number EM357 SoC available from Silicon Laboratories. Depending on the operating mode of system 205, circuitry 214 can operate in a relatively low power "listen" state or a relatively high power "transmit" state. When system 205 is in the Idle, WiFi update, or software update modes, circuitry 214 can be in the "listen" state. When system 205 is in the Alarm mode, circuitry 214 can transmit data so that the low power wireless communications circuitry in system 207 can receive data indicating that system 205 is alarming. Thus, even though it is possible for high power wireless communications circuitry 212 to be used for listening for alarm events, it is more power efficient to use low power circuitry 214 for this purpose. Power savings is further realized when several hazard detection systems or other systems having low power circuitry 214 form an interconnected wireless network.

Power savings is also realized because in order for low power circuitry 214 to continually listen for data transmitted from other low power circuitry, circuitry 214 must constantly be operating in its "listening" state. This state consumes power, and although it may consume more power than high power circuitry 212 operating in its sleep state, the power saved versus having to periodically activate high power circuitry 212 is substantial. When high power circuitry 212 is in its active state and low power circuitry 214 is in its transmit state, high power circuitry 212 consumes substantially more power than low power circuitry 214.

In some embodiments, low power wireless communications circuitry 214 can be characterized by its relatively low power consumption and its ability to wirelessly communicate according to a first protocol characterized by relatively low data rates, and high power wireless communications circuitry 212 can be characterized by its relatively high power consumption and its ability to wirelessly communicate according to a second protocol characterized by relatively high data rates. The second protocol can have a much more complicated modulation than the first protocol.

In some embodiments, low power wireless communications circuitry 214 may be a mesh network compatible module that does not require an access point or a router in order to communicate to devices in a network. Mesh network compatibility includes provisions that enable mesh network compatible modules to keep track of other nearby mesh network compatible modules so that data can be passed through neighboring modules. Mesh network compatibility is essentially the hallmark of the 802.15.4 protocol. In contrast, high power wireless communications circuitry 212 is not a mesh network compatible module and requires an access point or router in order to communicate to devices in a network. Thus, if a first device having circuitry 212 wants to communicate data to another device having circuitry 212, the first device has to communicate with the router, which then transmits the data to the second device. Thus, there is no device-to-device communication per se when circuitry 212 requires use of a router. In other embodiments, circuitry 212 can perform device-to-device communication using a Wi-Fi Direct communications protocol. The Wi-Fi Direct communications standard can enable devices to connect easily with each other without requiring a router. For example, an exemplary use of Wi-Fi Direct can enable hazard detection system 105 to directly communicate with thermostat 110.

Non-volatile memory 216 can be any suitable permanent memory storage such as, for example, NAND Flash, a hard disk drive, NOR, ROM, or phase change memory. In one embodiment, non-volatile memory 216 can store audio clips that can be played back by speaker 218. The audio clips can include installation instructions or warning in one or more languages. Speaker 218 can be any suitable speaker operable to playback sounds or audio files. Speaker 218 can include an amplifier (not shown).

Sensors 220 can be monitored by system processor 210 and safety processor 230, and can include safety sensors 221 and non-safety sensors 222. One or more of sensors 220 may be exclusively monitored by one of system processor 210 and safety processor 230. As defined herein, monitoring a sensor refers to a processor's ability to acquire data from that monitored sensor. That is, one particular processor may be responsible for acquiring sensor data, and possibly storing it in a sensor log, but once the data is acquired, it can be made available to another processor either in the form of logged data or real-time data. For example, in one embodiment, system processor 210 may monitor one of non-safety sensors 222, but safety processor 230 cannot monitor that same non-safety sensor. In another embodiment, safety processor 230 may monitor each of the safety sensors 221, but provide the acquired sensor data to system processor 210.

Safety sensors 221 can include sensors necessary for ensuring that hazard detection system 205 can monitor its environment for hazardous conditions and alert users when hazardous conditions are detected, and all other sensors not necessary for detecting a hazardous condition are non-safety sensors 222. In some embodiments, safety sensors 221 include only those sensors necessary for detecting a hazardous condition. For example, if the hazardous condition includes smoke and fire, then the safety sensors would only include a smoke sensor and at least one heat sensor. Other sensors, such as non-safety sensors, could be included as part of system 205, but would not be needed to detect smoke or fire. As another example, if the hazardous condition includes carbon monoxide, then the safety sensor would be a carbon monoxide sensor, and no other sensor would be needed to perform this task.

Thus, sensors deemed necessary can vary based on the functionality and features of hazard detection system 205. In one embodiment, hazard detection system 205 can be a combination smoke, fire, and carbon monoxide alarm system. In such an embodiment, detection system 205 can include the following necessary safety sensors 221: a smoke detector, a carbon monoxide (CO) sensor, and one or more heat sensors. Smoke detectors detect smoke and typically use optical scattering detection, ionization, or air sampling techniques. Optical scattering detection techniques may use infrared light emitting diodes (LEDs) and photodiodes. When smoke and/or other matter (e.g., water vapor) enters a smoke chamber, the light emitted by the LED(s) may be scattered, which may enable the photodiodes to detect the light. If no smoke or other matter (e.g., water vapor) is in the smoke chamber, then the photodiodes may not be able to detect the light being emitted by the LED(s). Ionization techniques may use a radioactive material such as Americium-241 to ionize the air, which may create a measurable current between two plates. When smoke particles displace the air or neutralize the charge, the measured current can change, thereby indicating smoke is detected. In some geographic locations (e.g., Europe) traditional Americium-241 ionization smoke detectors are banned by regulatory agencies in part because of the necessity to dispose of a radioactive material at the end of the smoke detector's life.

A smoke detector according to various embodiments discussed herein can use a non-radioactive ionization technique to detect the presence of smoke and/or other particulate matter. A non-radioactive ionizing detector may aim light at a plate coated with a photocatalyst coating. The photocatalyst can generate ions when light strikes it, thus creating a charge differential between two plates. When these ions are no longer generated because the light is unable to reach the photocatalyst coating, the change in charge differential may be registered as a smoke event.

A CO sensor can detect the presence of carbon monoxide gas, which, in the home, is typically generated by open flames, space heaters, water heaters, blocked chimneys, and automobiles. The material used in electrochemical CO sensors typically has a 5-7 year lifespan. Thus, after 5-7 year period has expired, the CO sensor should be replaced. A heat sensor can be a thermistor, which is a type of resistor whose resistance varies based on temperature. Thermistors can include negative temperature coefficient (NTC) type thermistors or positive temperature coefficient (PTC) type thermistors. Furthermore, in this embodiment, detection system 205 can include the following non-safety sensors 222: a humidity sensor, an ambient light sensor, a push-button sensor, a passive infra-red (PIR) sensor, and one or more ultrasonic sensors. A temperature and humidity sensor can provide relatively accurate readings of temperature and relative humidity. An ambient light sensor (ALS) sensor detects ambient light and the push-button sensor can be a switch, for example, that detects a user's press of the switch. A PIR sensor can be used for various motion detection features. A PIR sensor can measure infrared light radiating from objects in its field of view. Ultrasonic sensors can be used to detect the presence of an object. Such sensors can generate high frequency sound waves and determine which wave(s) are received back by the sensor. Sensors 220 can be mounted to a printed circuit board (e.g., the same board that processors 210 and 230 are mounted to), a flexible printed circuit board, a housing of system 205, or a combination thereof.

In some embodiments, data acquired from one or more non-safety sensors 222 can be acquired by the same processor used to acquire data from one or more safety sensors 221. For example, safety processor 230 may be operative to monitor both safety and non-safety sensors 221 and 222 for power savings reasons, as discussed above. Although safety processor 230 does not need any of the data acquired from non-safety sensor 222 to perform its hazard monitoring and alerting functions, the non-safety sensor data can be utilized to provide enhanced hazard system 205 functionality.

Alarm 234 can be any suitable alarm that alerts users in the vicinity of system 205 of the presence of a hazard condition. Alarm 234 can also be activated during testing scenarios. Alarm 234 can be a piezo-electric buzzer, for example.

Power source 240 can supply power to enable operation of system 205 and can include any suitable source of energy. Embodiments discussed herein can include AC line powered, battery powered, a combination of AC line powered with a battery backup, and externally supplied DC power (e.g., USB supplied power). Embodiments that use AC line power, AC line power with battery backup, or externally supplied DC power may be subject to different power conservation constraints than battery only embodiments. Battery powered embodiments are designed to manage power consumption of its finite energy supply such that hazard detection system 205 operates for a minimum period of time. In some embodiments, the minimum period of time can be one (1) year, three (3) years or seven (7) years. In other embodiments, the minimum period of time can be at least seven (7) years, eight (8) years, nine (9) years, or ten (10) years. Line powered embodiments are not as constrained because their energy supply is virtually unlimited. Line powered with battery backup embodiments may employ power conservation methods to prolong the life of the backup battery.

In battery only embodiments, power source 240 can include one or more batteries or a battery pack. The batteries can be constructed from different compositions (e.g., alkaline or lithium iron disulfide) and different end-user configurations (e.g., permanent, user replaceable, or non-user replaceable) can be used. In one embodiment, six cells of Li—FeS2 can be arranged in two stacks of three. Such an arrangement can yield about 27000 mWh of total available power for system 205.

Power conversion circuitry 242 includes circuitry that converts power from one level to another. Multiple instances of power conversion circuitry 242 may be used to provide the different power levels needed for the components within system 205. One or more instances of power conversion circuitry 242 can be operative to convert a signal supplied by power source 240 to a different signal. Such instances of power conversion circuitry 242 can exist in the form of buck converters or boost converters. For example, alarm 234 may require a higher operating voltage than high power wireless communications circuitry 212, which may require a higher operating voltage than processor 210, such that all required voltages are different the voltage supplied by power source 240. Thus, as can be appreciated in this example, at least three different instances of power conversion circuitry 242 are required.

High quality power circuitry 243 is operative to condition a signal supplied from a particular instance of power conversion circuitry 242 (e.g., a buck converter) to another signal. High quality power circuitry 243 may exist in the form of a low-dropout regulator. The low-dropout regulator may be able to provide a higher quality signal than that provided by power conversion circuitry 242. Thus, certain components may be provided with "higher" quality power than other components. For example, certain safety sensors such as smoke detectors and CO sensors may require a relatively stable voltage in order to operate properly.

Power gating circuitry 244 can be used to selectively couple and de-couple components from a power bus. De-coupling a component from a power bus insures that the component does not incur any quiescent current loss, and therefore can extend battery life beyond that which it would be if the component were not so de-coupled from the power bus. Power gating circuitry 244 can be a switch such as, for example, a MOSFET transistor. Even though a component is de-coupled from a power bus and does not incur any current loss, the power gating circuitry itself may consume a finite amount of power. This finite power consumption, however, is less than the quiescent power loss of the component.

It is understood that although hazard detection system 205 is described as having two separate processors, system processor 210 and safety processor 230, which may provide certain advantages, including advantages with regard to power consumption as well as with regard to survivability of core safety monitoring and alarming in the event of advanced feature provision issues, it is not outside the scope of the present teachings for one or more of the various embodiments discussed herein to be executed by one processor or by more than two processors.

Figure 3:
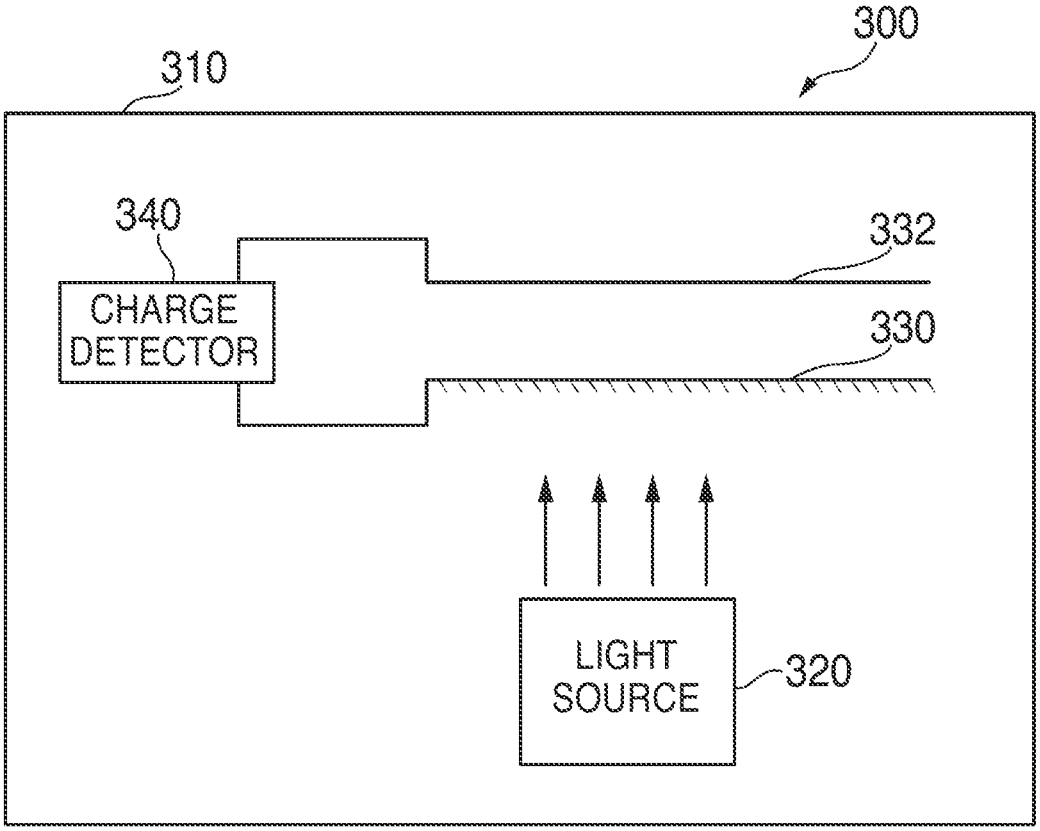
FIG. 3 shows an illustrative schematic of a non-radioactive ionization smoke detector system, according to an embodiment.

FIG. 3 shows an illustrative schematic of a non-radioactive ionization smoke detector system 300. As shown, system 300 can include smoke chamber 310, light source 320, photocatalytic plate 330, reference plate 332, and charge detector 340. Smoke chamber 310 may be any structure suitable for permitting the ingress and egress of particulate matter (e.g., gas, liquid, and solid matter). Light source 320, plates 330 and 332, and charge detector 340 may be contained within smoke chamber 310. If desired, however, charge detector 340 and other circuitry (not shown) may be contained outside of smoke chamber 310. Plates 330 and 332 may be arranged so that they are co-planar with respect to each other but offset by a fixed distance, and the plates may be placed anywhere within smoke chamber 310. Light source 320 may positioned and aimed such that any light emitted therefrom is directed toward at least one of plates 330 and 332.

Light source 320 may include one or more light emitting diodes (LEDs). In some embodiments, the LED may be any suitable LED capable of producing electromagnetic energy in the UV spectrum. For example, the LED may be a UV-A LED that provides UV energy in wavelengths ranging from 315 nm to 400 nm, or nominally at 365 nm. An advantage of UV-A LEDs is that they are mass producible and relatively inexpensive compared to other deeper UV LED designs. A UV-A LED may be constructed from Indium Gallium Nitride (InGaN) or Aluminum gallium nitride (A1GaN).

Plates 330 and 332 may be metal plates or other material suitable for holding a charge. One of the plates may be coated with a photocatalyst material and the other may serve as a reference. As illustrated in FIG. 3, plate 330 may be coated with a photocatalyst material. An example of photocatalytic material can be titanium dioxide ($TiO_2$). When UV energy strikes titanium dioxide, a photocatalytic oxidation event occurs to produce ions. More particularly, the photocatalytic process can create hydroxyl radicals and superoxide ions. These ions can be used for at least two different purposes: 1) smoke detection and 2) air purification. In the smoke detection context, the ions can cause plate 330 to have a "negative" charge relative to plate 332.

In the smoke detection context, the ions can cause plate 330 to have a different charge (e.g., "negative" charge) relative to plate 332. Charge detector 340 can detect the charge between the two plates and monitor them to determine whether an alarm event is occurring. In some embodiments, charge detector 340 may function as a voltage detector that measures a difference in voltage potential across plates 330 and 332. When smoke chamber 310 is substantially free and clear of particulates (e.g., smoke), the energy from light source 320 may sufficiently strike plate 330 to thereby create the ions that "negatively" charge the plate. When charge detector 340 monitors the charge in this state, it may expect a minimum charge differential to exist. If the minimum charge differential does not exist, this may trigger an alarm event. The presence of smoke or other particulates within smoke chamber 310 may prevent sufficient generation of ions to create the minimal charge differential. When this occurs, the smoke and/or particulates can be blocking the energy being emitted by light source 320, preventing it from striking plate 330.

In the air purification context, the ions can combine with elements in the air such as a bacteria and volatile organic compounds such as formaldehyde, ammonia, and other common contaminants. A chemical reaction takes place between the ion and pollutant that effectively oxidizes the pollutant. This may break the pollutant down in carbon dioxide and water, making the air more purified.

Figure 4:
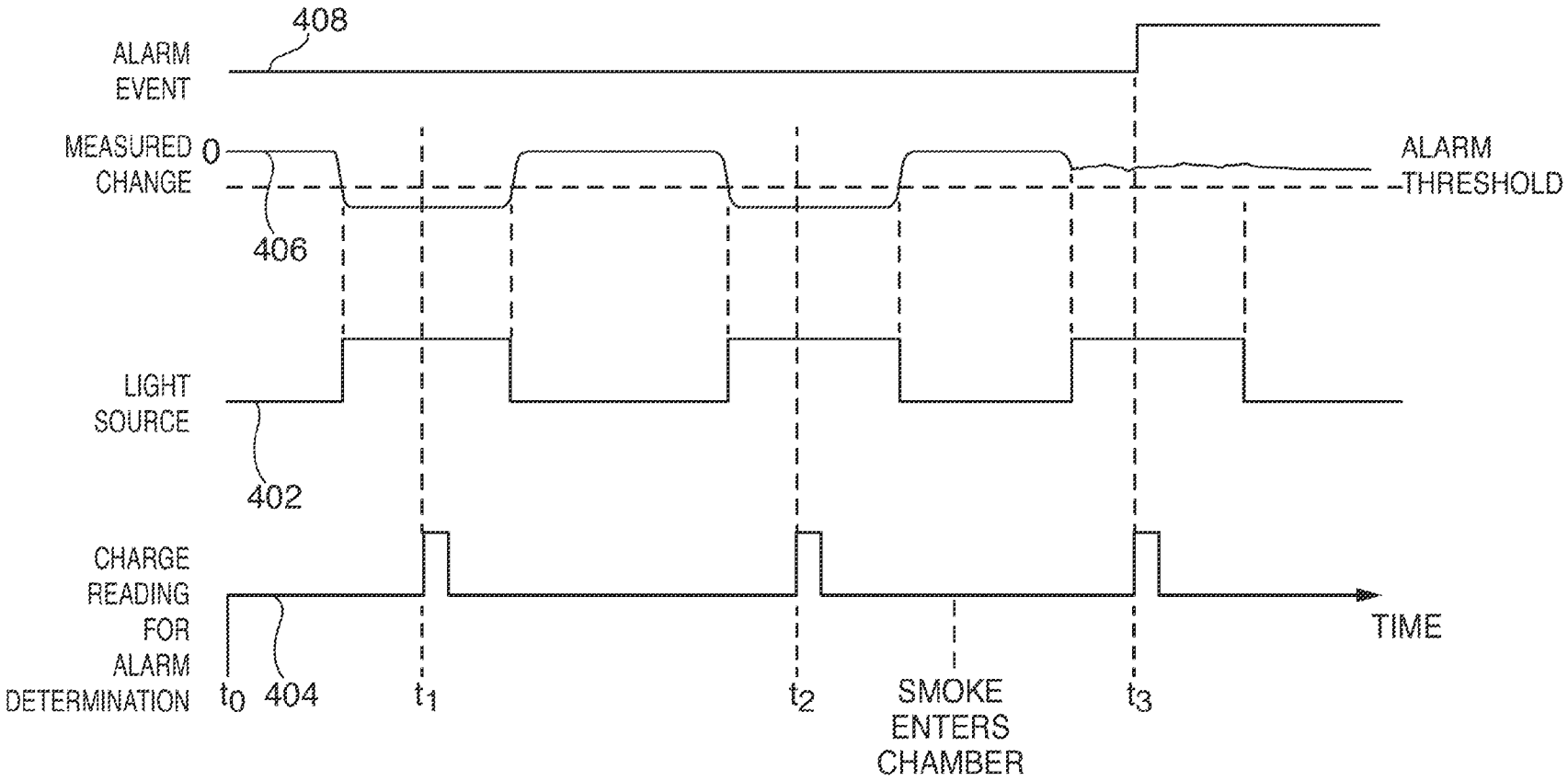
FIG. 4 shows an illustrative timing diagram showing measured charge over different conditions, according to an embodiment.

FIG. 4 shows an illustrative timing diagram showing measured charge over different conditions, according to an embodiment. As shown, waveforms are shown for alarm event, measured charge, light source, and charge reading. Light source waveform 402 may define a duty cycle for activating light source 320. For example, light source 320 may be duty cycled to conserve power. Charge reading waveform 404 may specify times during which charge detector 340 may measure plates 330 and 332 for their charge differential. As shown, detector 340 may make it readings while light source 320 is active. Detector readings may be made after the charge differential between the plates has had sufficient time to reach steady state. If desired, multiple charge readings may be made within an active period of light source 320 or while light source is inactive.

Measured charge waveform 406 shows the measured charge between plates 330 and 332. The measured charge may be negligible when no light energy is being imparted on plate 320. After the light source is turned OFF, the ions will react with the surrounding air and the charge difference will decay back to a negligible amount. When the light source is ON, and no smoke is present, the measure charge may exhibit a magnitude (shown here in the negative direction). This magnitude is shown to be below the alarm threshold, as illustrated by the dashed line. The smoke detector may trigger an alarm event depending on where this magnitude is relative to the alarm threshold during a charge reading for alarm determination. For example, at times t1 and t2, the magnitude of measured charge waveform 406 is below the alarm threshold. However, assume that between times, t2 and t3, smoke enters chamber 310. At time, t3, the measured charge magnitude is above the alarm threshold, thereby triggering an alarm event. This is shown by alarm event waveform 408, which goes HIGH at time, t3.

Figure 5:
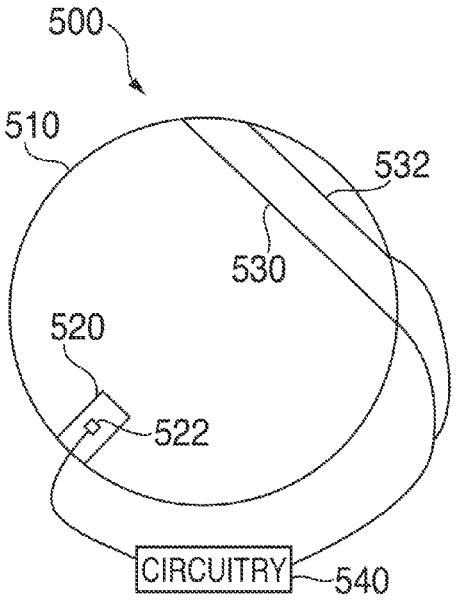
FIG. 5 shows an illustrative schematic of a non-radioactive smoke detection system, according to an embodiment.

FIG. 5 shows an illustrative schematic of a non-radioactive smoke detection system 500 according to an embodiment. As shown, system 500 can include smoke chamber 510, light source 520, photocatalytic plate 530, reference plate 532, and circuitry 540. Smoke chamber 510 may be any structure suitable for permitting the ingress and egress of particulate matter (e.g., gas, liquid, and solid matter). Light source 320 can include LED 321, which can be an LED capable of emitting energy in the ultra violet light spectrum. Light source 320 is aimed to emit light directly onto photocatalytic plate 530. The positioning of plates 530 and 532 is illustrative; however, in some embodiments, a minimum amount of space between light source 520 and plates 530 and 532 may be desired. The minimum spacing may enable smoke or other particulates to block light being emitted by light source 520. Circuitry 540 may control the operation of light source 520 and measure the charges on plates 530 and 532.

Figure 6:
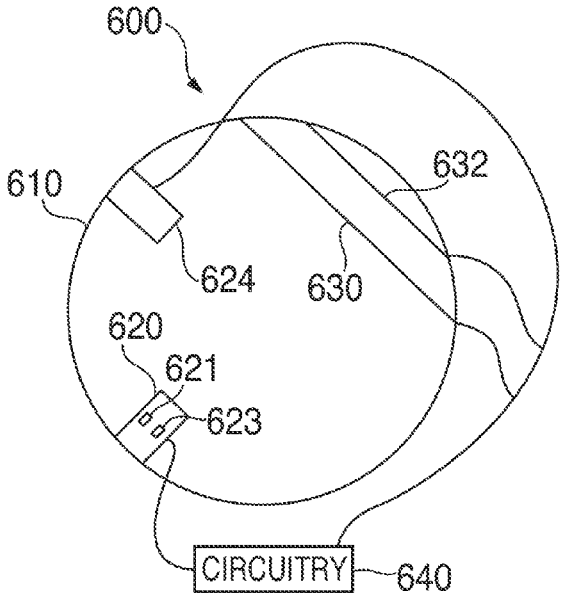
FIG. 6 shows another illustrative schematic of a non-radioactive smoke detection system, according to an embodiment.

FIG. 6 shows another illustrative schematic of a non-radioactive smoke detection system 600 according to an embodiment. As shown, system 600 can include smoke chamber 610, light source 620, photodiode 624, photocatalytic plate 630, reference plate 632, and circuitry 640. Circuitry 640 may be coupled to light source 620, photodiode 624, and plates 630 and 632. Light source 620 may include UV LED 621 and IR LED 623 in an integrated package. UV LED 621 may be a UV-A LED, which may have a nominal wavelength of about 365 nm to 400 nm and IR LED 623 may have a nominal wavelength of about 850 nm. The energy emitted by IR LED 623 may not be able to generate ions when it strikes photocatalytic plate 630.

System 600 uses two smoke detection techniques to monitor for smoke. The first technique may use the non-radioactively generated ions to detect the presence of smoking the ionization technique according to embodiments discussed herein. The second technique can use scattered light detection technique. In the second technique, when smoke or other matter is present, IR light is scattered and detected by photodiode 624. If sufficient light is detected, a signal (e.g., current) produced in response thereto may indicate the occurrence of an alarm event. Scattered light can be detected from either the IR light source or the UV light source. The varying levels from these two scatter signals, in addition to the level from the ionization sensor, may be used to help infer the particle contents in the chamber.

During operation, LEDs 621 and 623 may be turned on simultaneously or one at a time. For example, in one approach, both smoke detection techniques may be conducted simultaneously. This may be possible because the wavelengths of the light energy emitted by each LED are different and the intended recipient of the energy may only be able to use a particular wavelength. For example, photodiode 624 may be configured to only detect light in the IR wavelengths. As another example, photocatalytic plate 630 may only interact with light in the UV wavelengths. As another example, photodiode 624 may be able to detect scattered IR light and scattered UV light. Thus, in this example, both IR and UV scattered light detection may be used in combination with ionization detection.

Figure 7:
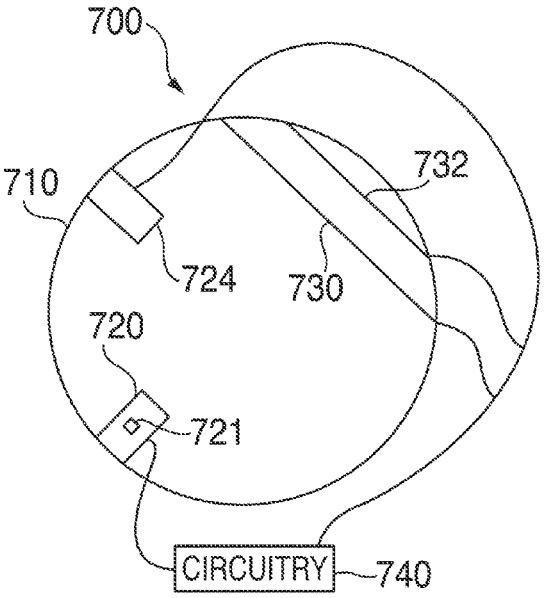
FIG. 7 shows yet another illustrative schematic of a non-radioactive smoke detection system, according to an embodiment.

FIG. 7 shows yet another illustrative schematic of a non-radioactive smoke detection system 700, according to an embodiment. System 700 is similar to system 600 in many respects, but deletes use of the IR LED. In system 700, UV LED 721 is used to perform smoke detection for both obscuration and light scattering detection methods. Photodiode 724 may be tuned to detect UV light as opposed to detecting IR light.

Figure 8:
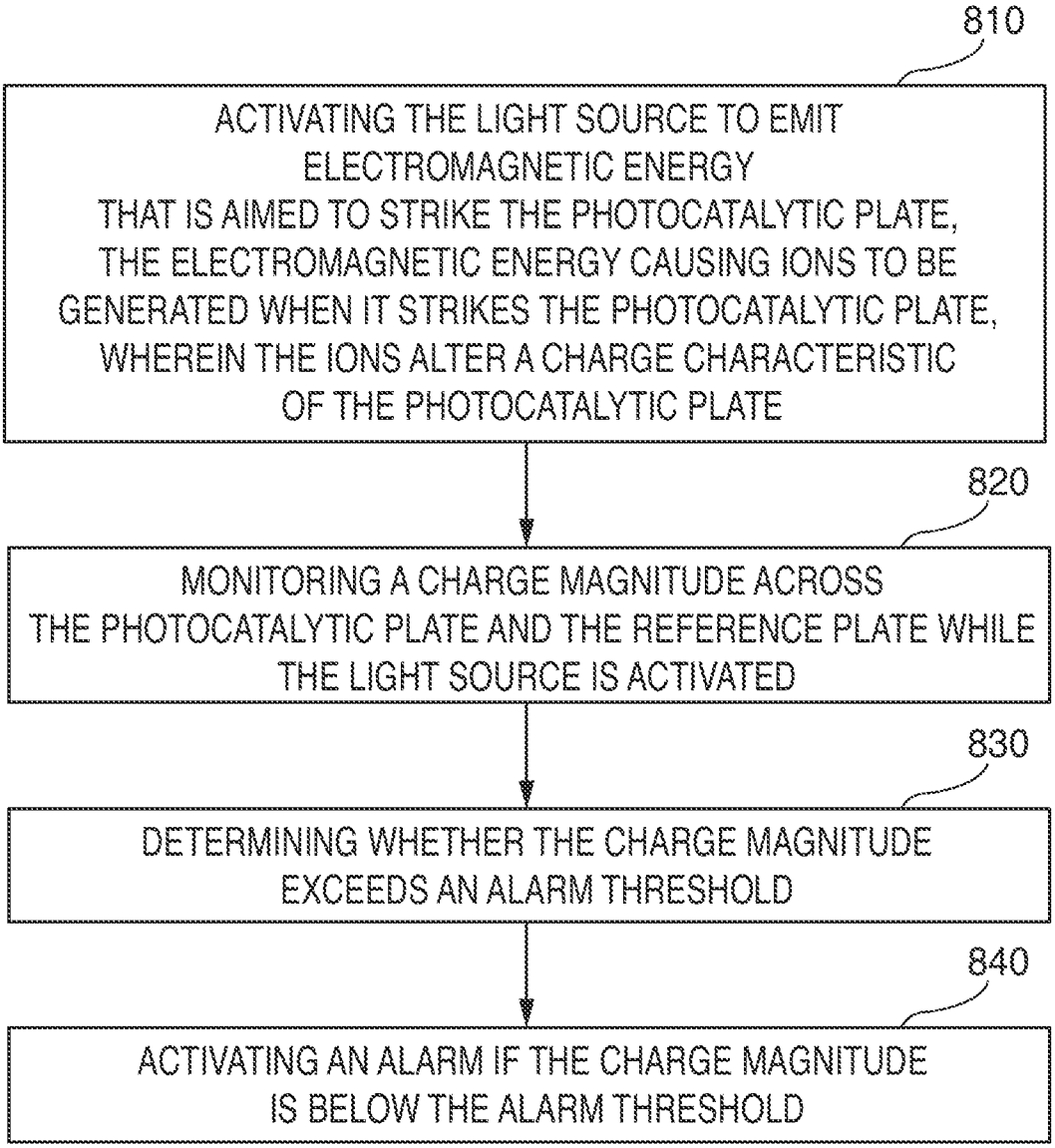
FIG. 8 shows an illustrative flowchart of steps for detecting particles using a non-radioactive hazard detector system, according to an embodiment.

FIG. 8 shows an illustrative flowchart of steps for detecting particles using a non-radioactive hazard detector system. The system may be, for example, any one of system 500, 600, and 700, discussed above. Beginning with step 810, a light source can be activated to emit electromagnetic energy that is aimed to strike a photocatalytic plate. The electromagnetic energy can cause ions to be generated when it strikes the photocatalytic plate, and the ions can alter a charge characteristic of the photocatalytic plate. At step 820, a charge magnitude across the photocatalytic plate and the reference plate can be monitored while the light source is activated. At step 830, a determination is made as to whether the charge magnitude exceeds an alarm threshold. For ease of discussion, the charge magnitude may be considered in terms of absolute value. Thus, when a substantial absence of particles exists within the detector system, this may enable a non-alarm quantity of emitted electromagnetic energy to strike the photocatalytic plate, thereby producing a non-alarm quantity of ions that results in a charge magnitude that exceeds the alarm threshold. When the charge magnitude exceeds the alarm threshold, this indicates that a sufficient quantity of electromagnetic energy is not being blocked by particles (e.g., smoke) and is striking the photocatalytic plate.

If particles are present within the detector system, this may prevents a non-alarm quantity of emitted electromagnetic energy from striking the photocatalytic plate, thereby producing an alarm quantity of ions that results in a charge magnitude that does not exceed the alarm threshold. As indicated in step 840, an alarm can be activated if the charge magnitude is below the alarm threshold.

It should be understood that the steps shown in FIG. 8 are merely illustrative and that additional steps may be added, steps may be omitted, and the order of steps may be rearranged.

For example, a photodiode can be used in combination with the light source to perform smoke detection using a light scattering technique. In this example, a single lone LED (e.g., UV LED) may be used for both obscuration and light scattering techniques. In another example, the light source can include an ultraviolet light emitting diode (UV-LED) and an infrared light emitting diode (IRLED), and the detector system can include a photodiode. In this configuration, the UVLED can be used in combination with the photocatalytic plate to perform obscuration detection, and the IRLED can be used in combination with the photodiode to perform light scattering detection.

Moreover, the processes described with respect to FIGS. 1-8, as well as any other aspects of the invention, may each be implemented by software, but may also be implemented in hardware, firmware, or any combination of software, hardware, and firmware. They each may also be embodied as machine- or computer-readable code recorded on a machine- or computer-readable medium. The computer-readable medium may be any data storage device that can store data or instructions which can thereafter be read by a computer system. Examples of the computer-readable medium may include, but are not limited to, read-only memory, random-access memory, flash memory, CD-ROMs, DVDs, magnetic tape, and optical data storage devices. The computer-readable medium can also be distributed over network-coupled computer systems so that the computer readable code is stored and executed in a distributed fashion. For example, the computer-readable medium may be communicated from one electronic subsystem or device to another electronic subsystem or device using any suitable communications protocol. The computer-readable medium may embody computer-readable code, instructions, data structures, program modules, or other data in a modulated data signal, such as a carrier wave or other transport mechanism, and may include any information delivery media. A modulated data signal may be a signal that has one or more of its characteristics set or changed in such a manner as to encode information in the signal.

It is to be understood that any or each module discussed herein may be provided as a software construct, firmware construct, one or more hardware components, or a combination thereof. For example, any one or more of the modules may be described in the general context of computer-executable instructions, such as program modules, that may be executed by one or more computers or other devices. Generally, a program module may include one or more routines, programs, objects, components, and/or data structures that may perform one or more particular tasks or that may implement one or more particular abstract data types. It is also to be understood that the number, configuration, functionality, and interconnection of the modules or state machines are merely illustrative, and that the number, configuration, functionality, and interconnection of existing modules may be modified or omitted, additional modules may be added, and the interconnection of certain modules may be altered.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Therefore, reference to the details of the preferred embodiments is not intended to limit their scope.

What is claimed is:

1. A non-radioactive ionizing smoke detection system, comprising:

a chamber having an interior volume and at least one opening to an ambient environment;

a pair of conductive plates contained in the interior volume, wherein one of the plates is coated with a photocatalytic coating;

a light source contained in the interior volume and aimed to emit electromagnetic energy towards the photocatalytic coated plate;

circuitry coupled to the conductive plates and the light source, the circuitry operative to:

activate the light source to emit electromagnetic energy that strikes the photocatalytic coated plate, the electromagnetic energy causing ions to be generated when it strikes the photocatalytic coated plate, wherein the ions alter a charge characteristic of the photocatalytic coated plate;

monitor a charge magnitude between the conductive plates to determine whether an alarm event is detected.

2. The system of claim 1, wherein the light source comprises an ultraviolet light emitting diode.

3. The system of claim 1, wherein the photocatalytic coating comprises titanium dioxide.

4. The system of claim 1, wherein the circuitry is operative to:

determine whether the charge magnitude exceeds an alarm threshold; and activate an alarm if the charge magnitude is below the alarm threshold.

5. The system of claim 4, wherein a substantial absence of particles within the chamber enables a non-alarm quantity of emitted electromagnetic energy to strike the photocatalytic coated plate, thereby producing a non-alarm quantity of ions that results in a charge magnitude that exceeds the alarm threshold.

6. The system of claim 4, wherein presence of particles within the chamber prevents a non-alarm quantity of emitted electromagnetic energy from striking the photocatalytic plate, thereby producing an alarm quantity of ions that results in a charge magnitude that does not exceed the alarm threshold.

7. The system of claim 1, wherein the circuitry is operative to activate the light source to purify air in the chamber.

8. The system of claim 1, further comprising:

a photodiode operative to detect energy emitted by the light source if sufficient particulates exist within the chamber to scatter the enemy in the direction of the photodiode, wherein the circuitry is operative to use the light source and the photodiode in a light scattering detection scheme to determine whether an alarm event is detected.

9. The system of claim 1, wherein the ions are generated without use of a radioactive material.

10. A non-radioactive ionizing smoke detection system, comprising:

a chamber having an interior volume and at least one opening to an ambient environment;

a photocatalytic coated conductive plate and a reference conductive plate contained in the interior volume;

a photodiode contained in the interior volume;

a light source contained in the interior volume, the light source comprising:

an ultraviolet (UV) light emitting diode (LED); and an infrared (IR) LED;

circuitry coupled to the conductive plates, the light source, and the photodiode, the circuitry operative to:

use an ion-based detection scheme to monitor for presence of particulate matter within the chamber; and use a light scattering detection scheme to monitor for presence of particulate matter within the chamber.

11. The system of claim 10, wherein the circuitry is operative to:

activate the UV LED to emit energy that interacts with the photocatalytic coated conductive plate to generate ions that changes a voltage potential between the conductive plates; and monitor the voltage potential between the conductive plates to determine whether an alarm event is detected.

12. The system of claim 10, wherein the circuitry is operative to:

activate the IR LED to emit IR energy; and monitor the photodiode to determine whether an alarm event is detected.

13. The system of claim 10, wherein the ion-based detection scheme uses the UV LED and the photocatalytic coated conductive plate and the light scattering scheme uses the IR LED and the photodiode.

14. A method for detecting particles in a non-radioactive ionizing hazard detector system comprising a light source, a photocatalytic plate, and a reference plate, the method comprising:

activating the light source to emit electromagnetic energy that is aimed to strike the photocatalytic plate, the electromagnetic energy causing ions to be generated when it strikes the photocatalytic plate, wherein the ions alter a charge characteristic of the photocatalytic plate;

monitoring a charge magnitude across the photocatalytic plate and the reference plate while the light source is activated;

determining whether the charge magnitude exceeds an alarm threshold; and activating an alarm if the charge magnitude is below the alarm threshold.

15. The method of claim 14, wherein a substantial absence of particles within the detector system enables a non-alarm quantity of emitted electromagnetic energy to strike the photocatalytic plate, thereby producing a non-alarm quantity of ions that results in a charge magnitude that exceeds the alarm threshold.

16. The method of claim 14, wherein presence of particles within the detector system prevents a non-alarm quantity of emitted electromagnetic energy from striking the photocatalytic plate, thereby producing an alarm quantity of ions that results in a charge magnitude that does not exceed the alarm threshold.

17. The method of claim 14, further comprising:

purifying air existing within the smoke detector when the light source is activated.

18. The method of claim 14, wherein the detector system further comprises a photodiode, the method further comprising:

determining whether the photodiode detects the electromagnetic energy when the light source is activated.

19. The method of claim 14, wherein the light source comprises an ultraviolet light emitting diode (UVLED) and an infrared light emitting diode (IRLED), and wherein the detector system further comprises a photodiode, the method further comprising:

using the UVLED in combination with the photocatalytic plate to perform obscuration detection; and using the IRLED in combination with the photodiode to perform light scattering detection.

* * * * *